United States Patent [19]

Cartwright et al.

[11] Patent Number: 4,734,141

[45] Date of Patent: Mar. 29, 1988

[54] CRASH BAG PROPELLANT COMPOSITIONS FOR GENERATING HIGH QUALITY NITROGEN GAS

[75] Inventors: Richard V. Cartwright, Sussex County, N.J.; Steven J. Hardwick, New Castle County, Del.

[73] Assignee: Hercules Incorporated, Wilmington, Del.

[21] Appl. No.: 30,802

[22] Filed: Mar. 27, 1987

[51] Int. Cl.[4] ..... C06G 35/00

[52] U.S. Cl. ..... 149/35; 102/531; 149/108.8; 252/188.31; 280/736; 280/741; 180/271

[58] Field of Search ..... 149/35, 108.8; 280/736, 280/741; 102/531; 252/188.31

[56] References Cited

U.S. PATENT DOCUMENTS

| | | | |
|---|---|---|---|
| 3,779,823 | 12/1973 | Price et al. | 149/35 |
| 3,797,854 | 3/1974 | Poole et al. | 149/35 |
| 3,895,098 | 7/1975 | Pietz | 423/351 |
| 3,912,561 | 10/1975 | Doin et al. | 149/35 |
| 3,920,575 | 11/1975 | Shiki et al. | 149/35 |
| 3,931,040 | 1/1976 | Breazeale | 252/188.3 R |
| 3,936,330 | 2/1976 | Dergazarian et al. | 149/35 |
| 3,977,924 | 8/1976 | McCulloch et al. | 149/35 |
| 4,021,275 | 5/1977 | Kishi et al. | 149/35 |
| 4,062,708 | 12/1977 | Goetz | 149/35 |
| 4,157,648 | 6/1979 | Brenman et al. | 149/35 |
| 4,203,787 | 5/1980 | Kirchoff et al. | 149/35 |
| 4,243,443 | 1/1981 | Utrecki | 149/35 |
| 4,390,380 | 6/1983 | Camp | 149/35 |
| 4,547,235 | 10/1985 | Schneiter et al. | 149/35 |
| 4,604,151 | 8/1986 | Knowlton et al. | 149/35 |

*Primary Examiner*—Stephen J. Lechert, Jr.
*Attorney, Agent, or Firm*—John E. Crowe

[57] ABSTRACT

A crash bag propellant composition and method for generating non-toxic nitrogen gas comprising an azide salt and an oxidant component in which metal oxides are substantially replaced with one or more bi-metallic complexes containing copper or iron in combination with chromium, molybdenum or tungsten.

32 Claims, No Drawings

CRASH BAG PROPELLANT COMPOSITIONS FOR GENERATING HIGH QUALITY NITROGEN GAS

The present invention relates to a gas-generating composition and process capable of rapidly producing sufficient quantities of an inert non-toxic gas for use as a crash bag propellant.

BACKGROUND

In general, the use of inflatable crash bags for protecting drivers and passengers involved in vehicular accidents is widely known.

In early versions of such devices, a compressed gas such as air, carbon dioxide, or nitrogen was stored, in situ, in a pressure bottle or flask, the valving of which was activated by sensing means responsive to rapid change in velocity or direct impact.

Generally speaking, such devices have been found unsatisfactory because of slow crash bag-inflation rates and the problem and expense of maintaining a pressure bottle or flask at the required pressure level over an indefinite period of time.

As a result, stored gas systems have now been generally replaced by gas-producing compositions, particularly ignitable (exothermic) gas-generating propellant compositions.

A system of the latter type must have a relatively short reaction time (10–60 milliseconds) to achieve the desired degree of bag inflation. In addition, it is very important that (a) the generated gas be essentially non-toxic and non-corrosive; (b) the exothermic reaction occur at a controlled rate to avoid generation of excessive heat capable of weakening or burning the crash bag, or passenger; (c) the propellant composition must retain both stability and reactivity for relatively long periods of time under at least normal driving conditions, including a wide range of ambient temperatures; and (d) the amount of propellant, its packaging and the bag itself must be very compact, light and storable within a steering column and/or dash panel.

Currently, most crash bag propellants contain an azide salt, or similar component capable of producing nitrogen or other inert gas when reacted with an oxidizer component.

Propellants compositions known to the art include, for instance, an alkali metal azide combined with an alkali metal oxidant, with an amide or tetrazole (U.S. Pat. No. 3,912,561); silicon dioxide with an alkali or alkaline earth metal plus a nitrite or perchlorate (U.S. Pat. No. 4,021,275); an alkali metal azide with a metal halide (U.S. Pat. No. 4,157,648); a plurality of metal azides with metal sulfides, metal oxides and sulfur (U.S. Pat. No. 3,741,585); an alkali earth metal plus an azide with a peroxide, perchlorate or nitrate (U.S. Pat. No. 3,883,373); an alkali metal azide with a metal oxide (iron, titanium or copper) (U.S. Pat. No. 3,895,098); an alkali metal-or alkaline earth metal-azide with an oxidant consisting of iron oxide doped with up to 1 wt. % of nickel or cobalt oxide (U.S. Pat. No. 4,376,002); and an alkali-or alkaline earth metal-azide combined with an oxidant obtained by forming a metal hydrated gel of a suitable base and metal salt, which is thereafter dehydrated in the presence of a metal oxide of aluminum, magnesium, chromium, manganese, iron, cobalt, copper, nickel, cerium and various transition series elements (U.S. Pat. No. 4,533,416).

While prior art, as above described and exemplified, covers a wide variety of possible azide/oxidizer compositions capable of producing nitrogen gas, continued efforts are being made to develop still more efficient propellant compositions offering acceptable T/P 50 values (time required to achieve 50% peak pressure) which are also safe (i.e. no intermediate product and components are produced in concentrations which are capable of reacting with acids to form explosive or corrosive intermediates such as copper azide), and (as above noted) which have a sufficiently low heat of reaction to avoid damage to the crash bag or harm to passengers, and which produce essentially no co-generated carbon monoxide gas.

It is an object of the present invention to develop a propellant composition and system which better achieves the above-enumerated goals and characteristics.

It is a further object to substantially reduce or eliminate the need for free metal oxides within oxidant components of crash bag propellants, particularly those capable of producing unstable metal azide intermediates.

It is still a further object to minimize the formation of fines and cracks in pelletized propellant compositions attributable to the presence of high concentrations of metal oxides in the propellent composition.

THE INVENTION

A method has been found for improving the stability and speed of azide/metal oxide-containing propellant compositions, comprising replacing metal oxides within the described oxidizer component with at least a stoichiometric amount of a metal complex represented by the formula $$M_{(a)}\,M_{(b)}{}^{l}\,X_{(c)}$$

wherein M is defined as copper or iron; $M^{l}$ is defined as chromium, molybdenum or tungsten; X is defined as an electronegative element selected from oxygen, sulfur, and chlorine; (a) has a value within the range of about 1–5; (b) has a value within the range of about 0.7–3.0; and (c) has a value within the range of about 4–12.

More specifically, it has been found that stability (i.e. speed of reaction of an azide with an oxidizer component) is more easily controlled, and the need for co-reactants lessened by replacing the usual art-recognized metal oxide oxidizer components as above described, such as copper, chromium, iron and zinc oxides, with an active amount (preferably stoichiometric amount) of a metal complex represented by the formula $$M_{(a)}{}^{ll}\,M_{(b)}{}^{lll}\,O_{(c)}$$

in which $M^{ll}$ is defined as copper or iron; $M^{lll}$ is defined as chromium or molybdenum; (c) is defined as above; and the ratio of (b)/(a) does not exceed 2.

Propellant compositions of particular interest within the above sub class comprise, for instance, combinations of sodium or potassium azide with one or more complexes represented by the formulae:

$$Cu_{4.41}\,Cr_{0.77}\,O_{5.00},$$

$$Cu_{2.20}\,Cr_{2.85}\,O_{7.00},$$

$$Cu_{2.93}\,Cr_{2.85}\,O_{7.00},$$

$CuMoO_{4.00}$, $FeWO_{4.00}$, and $Fe_2Mo_3O_{12.00}$.

Also conveniently includible within propellant compositions of the present invention, are additives commonly used in the tabletting art such as (1) binders, (both inorganic and organic), exemplified by microcrystalline cellulose, dicalcium phosphate, polyvinyl pyrrolidone and the like, the choice and amount of such additive generally favoring avoidance or minimizing production of carbon monoxide. For this reason organic additives generally do not exceed about 5% by weight. The use of pellets or tablets minimizes segregation of components induced by vibration over a period of time, and, thereby, assures a more predictable speed of reaction and control over the amount of heat generated per unit of time;

(2) lubricants such as magnesium stearate, calcium stearate and aluminum stearate (0.1–1.0%) are optionally included;

(3) water proofing materials such as dilute solutions of ethyl cellulose, cellulose acetate or nitrocellulose for protecting the generally hygroscopic azide propellant component;

(4) burn rate enchancers such as ammonium perchlorate, $MnO_2$, $Fe_2O_3$ and NiO (0.05–1.0 wt.%); and the like.

Cu/Cr complexes within the above-defined class of compositions are commercially obtainable, for instance, from Harshaw-Filtrol Partnership of Cleveland, Ohio, while corresponding Cu/Mo, Fe/W, and Fe/Mo complexes (see Example) are commercially obtainable from Alfa Products Division of Morton Thiokol Co. of Danvers, Mass.

For descriptive and formulation purposes the following general reaction formula is found useful:

$$2z\ NaN_3 + M_xM_y{}^1O_z \rightarrow 3z\ N_2 + x\ M + y\ M^1 + z\ Na_2O.$$

Particularly preferred propellant compositions of the instant invention can conveniently contain a ratio by weight of alkali metal azide-to-oxidant varying from about (50%–63%)-to-(40%–27%), the balance (here about 10% by weight) comprising known additives such as binder, lubricant, water proofing material and the like, as above-enumerated. The manufacture of propellant compositions of the instant invention can be conveniently carried out by wet or dry granulation of one or both of the azide and oxidant components and the mixture (with binder and lubricant additives) compressed into tablets or pellets in the usual manner. Background information concerning such processes for producing propellants can be found, for instance, in U.S. Pat. Nos. 3,996,079 and 4,376,002.

Gas generating units, means for ignition, and sensing devices suitable for use with propellant compositions of the present invention are also conveniently described, for instance, in U.S. Pat. Nos. 3,450,414 (Kobori et al), 3,904,221 (Shiki et al), 3,741,585 (Hendrickson), and 4,094,028 (Fujiyama et al).

The instant invention is further illustrated but not limited by the following Examples and Tables.

EXAMPLE

Utilizing dry screened (100 mesh) components, propellant compositions S-1 through S-11 are prepared, using sodium azide*1 with an indicated percent-by-weight of bimetallic complexes as oxidizer components, plus microcrystalline cellulose (10%) and magnesium stearate (0.5%) as binder and lubricant.

Controls S-10 and S-11 differ in the use of Copper (II) Oxide and Iron (III) Oxide as oxidizer components for purposes of comparison with respect to (a) maximum pressure and (b) speed of reaction.

After thorougly mixing each composition batch, the batch is pelletized, using a Stokes Model A-3 Tabletting Machine with punches and die of 0.25" diameter, to obtain cylindrical propellant pellets within the range of 0.09–0.11 gm.

The above-identified propellant compositions (see Table I) are individually tested by packing in a 180 ml closed test bomb in the usual art-recognized manner, using an electric match to ignite a charge consisting of: 11 grams of pelletized propellant mixture (i.e. S-1 through S-11), plus 0.6 gram of granular igniter powder consisting of 69.7% $KNO_3$, 24.5% Boron and 5.8% Laminac binder*12.

(*12) Tracor IP-10 from Tracor MB Associates, East Camden, Ariz.

Test bomb data is processed and reported in Table II below, using a Norland 3001 wave form analyzer (Pressure vs. Time in 0.001 second intervals), and an average peak pressure value is obtained.

Three separate determinations are utilized and reported to measure relative propellant reaction rates as follows:

1. Quickness (the geometrical area under a graph of the ratio of pressure increase (i.e. dp/dt) as a function of pressure over a range of 25% through 70% of maximum pressure.
2. dp/dt at 1000 psi (i.e. the anticipated region of fastest pressure increase); and
3. Time (in milliseconds) at which the bomb pressure realized is respectively 25%, 50% and 75% of maximum pressure.

TABLE I

| Samples | % by Weight*11 | Complex | Binder*6 (% by Weight) | Lubricant*7 (% by Weight) |
|---|---|---|---|---|
| S-1 | 55.4/34.1 | Copper II | 10 | .5 |
| S-2 | 61.6/37.9 | Chromite*2*9 | 0 | .5 |
| S-3 | 62.2/27.3 | Copper(II) | 10 | .5 |
| S-4 | 69.1/30.4 | Chromite*2*10 | 0 | .5 |
| S-5 | 62.6/26.9 | Copper (II) | 10 | .5 |
| S-6 | 69.6/29.9 | Molybdate*3 | 0 | .5 |
| S-7 | 63.3/26.2 | Iron(II) Molybdate*3 | 10 | .5 |
| S-8 | 64.9/24.6 | Iron(III) Molybdate*3 | 10 | .5 |
| S-9 | 56.5/33.0 | Iron II Tungstate*3 | 10 | .5 |
| S-10*8 | 55.5/34.0 | Copper (II) Oxide*4 | 10 | .5 |
| S-11*8 | 63.5/26.0 | Iron (III) Oxide*5 | 10 | .5 |

*1Charkit Chemical Corporation, Darien, CT;
*2Harshaw-Filtrol Partnership, Cleveland, Ohio (Catalyst grade);
*3Alfa Products, Danvers, MA;
*4Matheson, Coleman & Bell, East Rutherford, NJ (ACS Reagent);
*5Charles Pfizer Inc., Easton, PA (99+%);
*6Avicel PH-101 microcrystalline cellulose; FMC Corp., Philadelphia, PA.;
*7Magnesium Stearate; Synthetic Products Company, Cleveland, Ohio;
*8Control;
*9$Cu_{4.41}Cr_{0.77}O_5$;
*10$Cu_{2.20}Cr_{2.85}O_7$;
*11Ratio of Sodium Azide/Complex.

TABLE II

| Sample | Oxidant Complex | Max. Bomb Pressure (psi) | dp/dt @ p = 1000 psi (Kpsi/sec) | Quickness*13 (Kpsi²/sec) | Time/Peak Pres. (msec)*12 25% | 50% | 75% |
|---|---|---|---|---|---|---|---|
| S-1 | Copper (II) Chromite*9 | 1916 | 53.0 | 44.0 | 18 | 29 | 38 |
| S-2 | Copper (II) Chromite*9 | 1770 | 52.9 | 40.9 | 12 | 21 | 30 |
| S-3 | Copper (II) Chromite*10 | 1822 | 19.9 | 15.7 | 47 | 78 | 102 |
| S-4 | Copper (II) Chromite*10 | 1559 | 13.7 | 10.3 | 23 | 51 | 82 |
| S-5 | Copper (II) Molybdate | 1932 | 29.1 | 23.1 | 40 | 61 | 78 |
| S-6 | Copper (II) Molybdate | 1918 | 33.8 | 27.8 | 42 | 61 | 76 |
| S-7 | Iron (II) Molybdate | 1771 | 16.3 | 12.0 | 60 | 96 | 126 |
| S-8 | Iron (III) Molybdate | 1917 | 16.3 | 12.9 | 54 | 92 | 124 |
| S-9 | Iron (II) Tungstate | 1541 | 8.4 | 5.2 | 122 | 185 | 233 |
| S-10 | Copper (II) Oxide | 1777 | 23.8 | 17.3 | 50 | 73 | 93 |
| S-11 | Iron (III) Oxide | 1554 | 4.1 | 2.7 | 163 | 273 | 382 |

*12Time in milliseconds to achieve indicated percentage of peak pressure.
*13Relative measure of reaction speed based on geometrical area within a graph of dp/dt as a function of pressure within the 25%–70% maximum pressure range (reference page 7).

What we claim and desire to protect by Letters Patent is:

1. A method for improving the stability and speed of azide/oxidizer containing propellant compositions comprising replacing metal oxides within the oxidizer component with an active amount of a metal complex represented by the formula $$M_{(a)}\,M_{(b)}^{l}\,X_{(c)}$$

wherein M is defined as copper or iron; $M^l$ is defined as chromium, molybdenum or tungsten; X is defined as an electronegative element selected from the group consisting of oxygen, sulfur, and chlorine; (a) has a value within the range of about 1–5; (b) has a value within the range of about 0.7–3.0; and (c) has a value within the range of 4–12.

2. The method of claim 1, wherein the metal complex is represented by the formula $$M_{(a)}^{ll}\,M_{(b)}^{lll}\,O_{(c)}$$

in which $M^{ll}$ is defined as copper or iron; $M^{lll}$ is defined as chromium or molybdenum; (c) has a value within the range of about 4–12; and the ratio of (b)/(a) does not exceed 2.

3. The method of claim 2, wherein the azide component of the propellant composition is sodium azide or potassium azide and the metal complex is represented by the formula.

$$Cu_{4.41}Cr_{0.77}O_{5.00}.$$

4. The method of claim 2, wherein the azide component of the propellant composition is sodium azide or potassium azide and the metal complex is represented by the formula $$Cu_{2.20}Cr_{2.85}O_{7.00}.$$

5. The method of claim 2, wherein the azide component is sodium azide or potassium azide and the metal complex is represented by the formula $$Cu_{2.93}Cr_{2.85}O_{7.00}.$$

6. The method of claim 2, wherein the azide component of the propellant composition is sodium azide or potassium azide and the metal complex is represented by the formula $$Cu\ Mo\ O_{4.00}.$$

7. The method of claim 1, wherein the azide component of the propellant composition is sodium azide or potassium azide and the metal complex is represented by the formula $$Fe\ WO_{4.00}.$$

8. The method of claim 2, wherein the azide component of the propellant composition is sodium azide or potassium azide; and the metal complex is represented by the formula $$Fe_2\ Mo_3\ O_{12.00}.$$

9. A gas-generating propellant composition comprising, in combination, (a) an alkali or alkaline earth metal azide component, and (b) an active amount of an oxidizer complex of the formula $$M_{(a)}M_{(b)}^{l}\,X_{(c)}$$

wherein M is defined as copper or iron; $M^l$ is defined as chromium, molybdenum or tungsten; X is defined as an electronegative element selected from the group consisting of oxygen, sulfur, and chlorine;

(a) has a value within the range of about 1–5;

(b) has a value within the range of about 0.7–3.0; and (c) has a value within the range of about 4–12.

10. A nitrogen gas-generating propellant composition of claim 9, wherein the azide component is an alkali or alkaline earth metal azide component; and the oxidizer complex has the formula:

$$M_{(a)}^{ll}\,M_{(b)}^{lll}\,O_{(c)}$$

in which $M^{ll}$ is defined as copper or iron; $M^{lll}$ is defined as chromium or molybdenum; (c) has a value within the range of about 4–12; and the ratio of (b)/(a) does not exceed 2.

11. The nitrogen gas-generating propellant of claim 11, wherein the azide component is sodium azide or potassium azide; and the oxidizer complex has the formula $$Cu_{4.41}Cr_{0.77}O_{5.00}.$$

12. The nitrogen gas-generating propellant composition of claim 10, wherein the azide component is sodium azide or potassium azide and the oxidizer complex has the formula $$Cu_{2.20}Cr_{2.85}O_{7.00}.$$

13. The nitrogen gas-generating propellant composition of claim 10, wherein the azide component is sodium or potassium azide, and the oxidizer complex has the formula $Cu_{2.93}Cr_{2.85}O_{7.00}$.

14. The nitrogen gas-generating propellant composition of claim 10, wherein the azide component is sodium or potassium azide, and the oxidizer complex has the formula $Cu\ Mo\ O_{4.00}$.

15. The nitrogen gas-generating propellant composition of claim 9, wherein the azide component is sodium or potassium azide, and the oxidizer complex has the formula $Fe\ WO_{4.00}$.

16. The nitrogen gas-generating propellant composition of claim 10, wherein the azide component is sodium or potassium azide, and the oxidizer complex has the formula $Fe_2Mo_3O_{12.00}$.

17. The propellant composition of claim 9 containing at least one of a binder and a lubricant.

18. The propellant composition of claim 10 containing at least one of a binder and a lubricant.

19. The propellant composition of claim 11 containing at least one of a binder and a lubricant.

20. The propellant composition of claim 12 containing at least one of a binder and a lubricant.

21. The propellant composition of claim 13 containing at least one of a binder and a lubricant.

22. The propellant composition of claim 14 containing at least one of a binder and a lubricant.

23. The propellant composition of claim 15 containing at least one of a binder and a lubricant.

24. The propellant composition of claim 16 containing at least one of a binder and a lubricant.

25. A safety crash bag device comprising, in combination, an inflatable bag of desired shape receivably connected to a gas-generating means charged with an active amount of gas-generating propellant composition as defined in claim 9, and in proximity to means for ignition arranged in potential firing attitude with respect to said gas-generating propellant; and impact detecting means functionally connected to said detonating means for firing of said detonating means upon exposure to an impact of predetermined severity; wherein an impacting force on said impact detecting means effects a firing sequence through said means for ignition of said gas-generating propellant, essentially producing inert nitrogen gas in said gas-generating means, and passing said gas to said inflatable bag to create a shock-absorbing barrier.

26. A safety crash bag device comprising, in combination, an inflatable bag of desired shape receivably connected to a gas-generating means charged with an active amount of gas-generating propellant composition as defined in claim 10, and in proximity to means for ignition arranged in potential firing attitude with respect to said gas-generating propellant; and impact-detecting means functionally connected to said detonating means for firing of said detonating means upon exposure to an impact of predetermined severity; wherein an impacting force on said impact-detecting means effects a firing sequence through said means for ignition of said gas-generating propellant, essentially producing inert nitrogen gas in said gas-generating means, and passing said gas to said inflatable bag to create a shock-absorbing barrier.

27. A safety crash bag device comprising, in combination, an inflatable bag of desired shape receivably connected to a gas-generating means charged with an active amount of gas-generating propellant composition as defined in claim 11, and in proximity to means for ignition arranged in potential firing attitude with respect to said gas-generating propellant; and impact-detecting means functionally connected to said detonating means for firing of said detonating means upon exposure to an impact of predetermined severity; wherein an impacting force on said impact-detecting means effects a firing sequence through said means for ignition of said gas-generating propellant, essentially producing inert nitrogen gas in said gas-generating means, and passing said gas to said inflatable bag to create a shock-absorbing barrier.

28. A safety crash bag device comprising, in combination, an inflatable bag of desired shape receivably connected to a gas-generating means charged with an active amount of gas-generating propellant composition as defined in claim 12, and in proximity to means for ignition arranged in potential firing attitude with respect to said gas-generating propellant; and impact-detecting means functionally connected to said detonating means for firing of said detonating means upon exposure to an impact of predetermined severity; wherein an impacting force on said impact-detecting means effects a firing sequence through said means for ignition of said gas-generating propellant, essentially producing inert nitrogen gas in said gas-generating means, and passing said gas to said inflatable bag to create a shock-absorbing barrier.

29. A safety crash bag device comprising, in combination, an inflatable bag of desired shape receivably connected to a gas-generating means charged with an active amount of gas-generating propellant composition as defined in claim 13, and in proximity to means for ignition arranged in potential firing attitude with respect to said gas-generating propellant; and impact-detecting means functionally connected to said detonating means for firing of said detonating means upon exposure to an impact of predetermined severity; wherein an impacting force on said impact-detecting means effects a firing sequence through said means for ignition of said gas-generating propellant, essentially producing inert nitrogen gas in said gas generating means, and passing said gas to said inflatable bag to create a shock-absorbing barrier.

30. A safety crash bag device comprising, in combination, an inflatable bag of desired shape receivably connected to a gas-generating means charged with an active amount of gas-generating propellant composition as defined in claim 14, and in proximity to means for ignition arranged in potential firing attitude with respect to said gas-generating propellant; and impact-detecting means functionally connected to said detonating means for firing of said detonating means upon exposure to an impact of predetermined severity; wherein an impacting force on said impact-detecting means effects a firing sequence through said means for ignition of said gas-generating propellant, essentially producing inert nitrogen gas in said gas generating means, and passing said gas to said inflatable bag to create a shock-absorbing barrier.

31. A safety crash bag device comprising, in combination, an inflatable bag of desired shape receivably connected to a gas-generating means charged with an active amount of gas-generating propellant composition as defined in claim 15, and in proximity to means for ignition arranged in potential firing attitude with respect to said gas-generating propellant; and impact-detecting means functionally connected to said detonating means for firing of said detonating means upon exposure to an impact of predetermined severity; wherein an impacting force on said impact-detecting means effects a firing sequence through said means for ignition of said gas-generating propellant, essentially producing inert nitrogen gas in said gas generating means, and passing said gas to said inflatable bag to create a shock-absorbing barrier.

32. A safety crash bag device comprising, in combination, an inflatable bag of desired shape receivably connected to a gas-generating means charged with an active amount of gas-generating propellant composition as defined in claim 16, and in proximity to means for ignition arranged in potential firing attitude with respect to said gas-generating propellant; and impact-detecting means functionally connected to said detonating means for firing of said detonating means upon exposure to an impact of predetermined severity; wherein an impacting force on said impact-detecting means effects a firing sequence through said means for ignition of said gas-generating propellant, essentially producing inert nitrogen gas in said gas generating means, and passing said gas to said inflatable bag to create a shock-absorbing barrier.

* * * * *